US005819581A

United States Patent [19]

Winton, III

[11] Patent Number: 5,819,581

[45] Date of Patent: Oct. 13, 1998

[54] MECHANISM TO PREVENT ROTATION

[76] Inventor: George R. Winton, III, 242 Ashbourne Trail, Lawrenceville, Ga. 30243

[21] Appl. No.: 813,705

[22] Filed: Mar. 7, 1997

[51] Int. Cl.[6] ..... B21D 7/02; B21D 7/024

[52] U.S. Cl. ..... 72/458; 72/217; 72/479; 16/111 R

[58] Field of Search ..... 72/458, 459, 479, 72/319, 320, 321, 217, 218, 387; 16/111 R

[56] References Cited

U.S. PATENT DOCUMENTS

| | | | |
|---|---|---|---|
| 1,265,102 | 5/1918 | Morris | 72/217 |
| 2,492,360 | 12/1949 | English | 72/217 |
| 3,248,921 | 5/1966 | Trout | 72/458 |
| 3,685,335 | 8/1972 | Kowal | 72/319 |
| 3,757,560 | 9/1973 | Hargash | 72/458 |
| 4,167,865 | 9/1979 | Powell . | |
| 4,608,849 | 9/1986 | Brugman | 72/217 |
| 4,765,168 | 8/1988 | Stange et al. | 72/159 |
| 5,220,818 | 6/1993 | Hansen | 72/459 |
| 5,626,045 | 5/1997 | Bulle | 72/321 |

*Primary Examiner*—David Jones

[57] ABSTRACT

A mechanism to prevent a handle from rotating out of the plane of bending during the bending of a tube. This mechanism is used in a compression bending process in conjunction with a hinged handle. The mechanism prevents the handle from rotating about the hinged point during the bending process. The mechanism adds rigidity to the bending device and is thus responsible for limiting excess deforming of the work piece.

4 Claims, 5 Drawing Sheets

MECHANISM TO PREVENT ROTATION

BACKGROUND OF THE INVENTION

The present invention relates to a mechanism used to lock a handle in position during a compression bending process and more particularly, a mechanism to prevent a bending handle from rotating about a hinged axis during a compression bending process.

DESCRIPTION OF THE RELATED ART

In the tube fabrication industry it is common to bend small diameter tubing by making use of a compression bending process. Unlike the rotary draw process for bending tubing, the compression bending process is simple in nature. Simply clamp the tube in position and force the tube around a die. This technique has been discussed in numerous prior arts such as the bender discussed in U.S. Pat. No. 3,448,602, issued to J. H. Stanley on Jun. 10, 1969 and U.S. Pat. No. 3,685,335, issued to Leonard J. Kowal on Aug. 22, 1972. These prior arts disclose devices that depict the compression bending process in its most simplistic form. Both benders firmly hold a tube in position while a handle assembly arrangement is used to deform the tube around a bend die. In both cases, the bend handle assemblies are permitted only to rotate in the plane of bending and thus prevented from rotating out of the plane of bending.

A similar apparatus is disclosed in U.S. Pat. No. 4,167,865, issued to Francis R. Powell on Sep. 18, 1979. This hand bender also makes use of a handle assembly that is only free to rotate in the plane of bending. Therefore, because of its construction, the bending handle assembly is prevented from rotating out of the plane of bending.

A limitation of the conventional hand benders is their inability to remove the handle from the plane of bending for the purpose of loading and/or unloading the next work piece. Quite often, the handles described in the mentioned prior arts cause delays in a production environment due to the fact that an operator of the hand benders must work around the bend handle assemblies that are constantly in the plane of bending during the loading and unloading of the work piece.

This problem has been addressed over the years yet has met with little success by employing a handle assembly that rotates up and out of the plan of bending much like a waffle iron opens. This technique relies on the handle assembly to self lock onto the work piece as the handle assembly advances in the plane of bending. This technique has experienced limited results due to the reaction force on the handle assembly during the bending process. The reaction force from the tube on the handle assembly during the bending process tends to lift the handle assembly up and out of the plane of bending during the bending process. This action can cause significant scratches and/or over deform the tube in the are of the bend.

SUMMARY OF THE INVENTION

Accordingly, it is an object of the present invention to restrict the hinged handle from rotating out of the bending plane during a compression bending process;

It is another object of the present invention to limit the amount of scratches and/or excess distorting of the work piece during a compression bending process;

Further objects and advantages are to allow an operator to remove the handle from the bending plane for ease of loading and unloading of the work piece. Still further objects and advantages will become apparent from a consideration of the ensuing description and drawings.

DESCRIPTION OF THE PREFERRED EMBODIMENTS

Reference will now be made in detail to the present preferred embodiments of the present invention and examples of which are illustrated in accompanying drawings.

Figure 1:
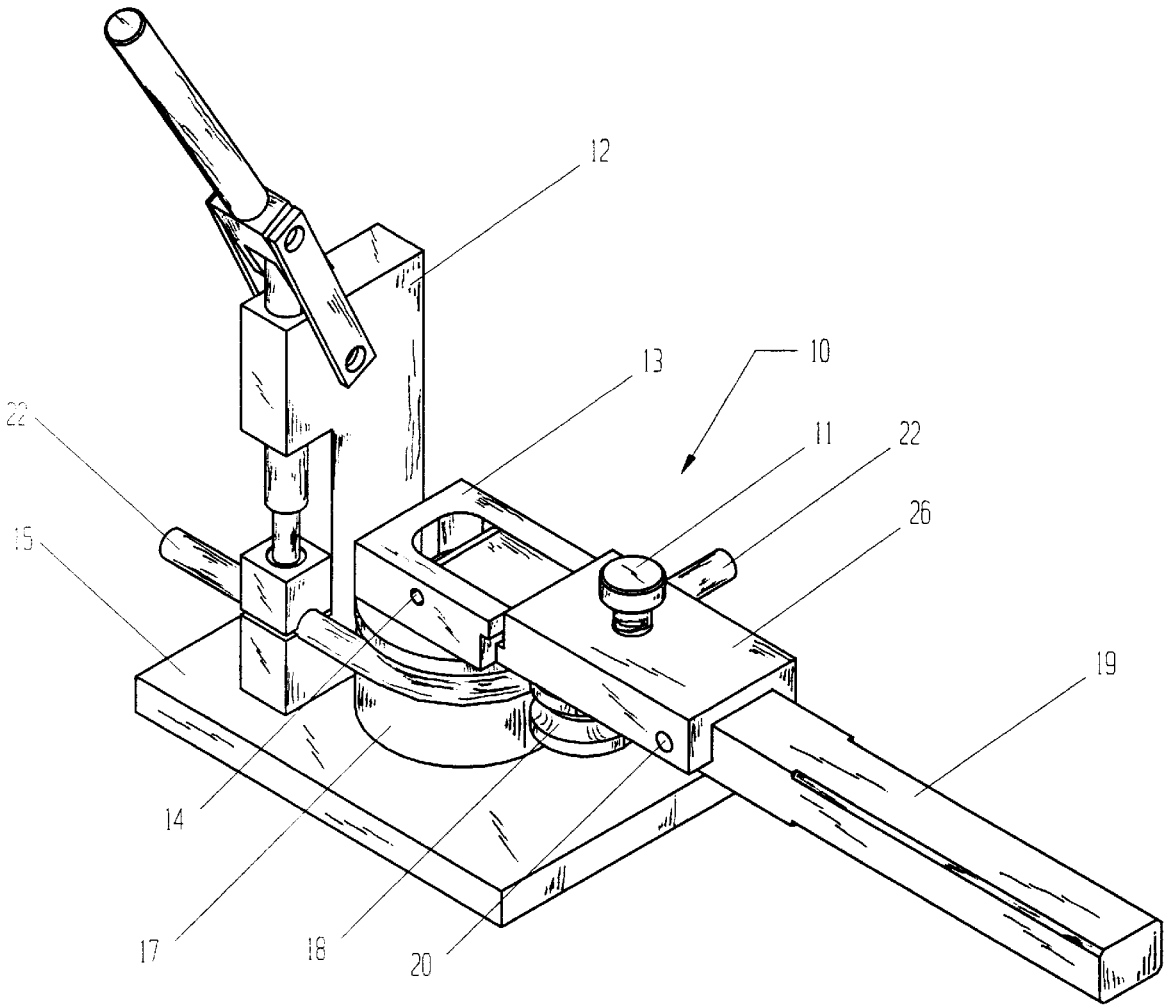
FIG. 1 shows a compression bending device with the inventive interlocking mechanism that only allows the handle assembly to rotate in the plane of bending during the bending process.

In FIG. 1, the first embodiment 10 is shown. A clamp assembly 12 is fastened to a base 15. A bend die 17 is also fastened to base 15. Placed between clamp assembly 12 and bend die 17 is a work piece 22.

Figure 2:
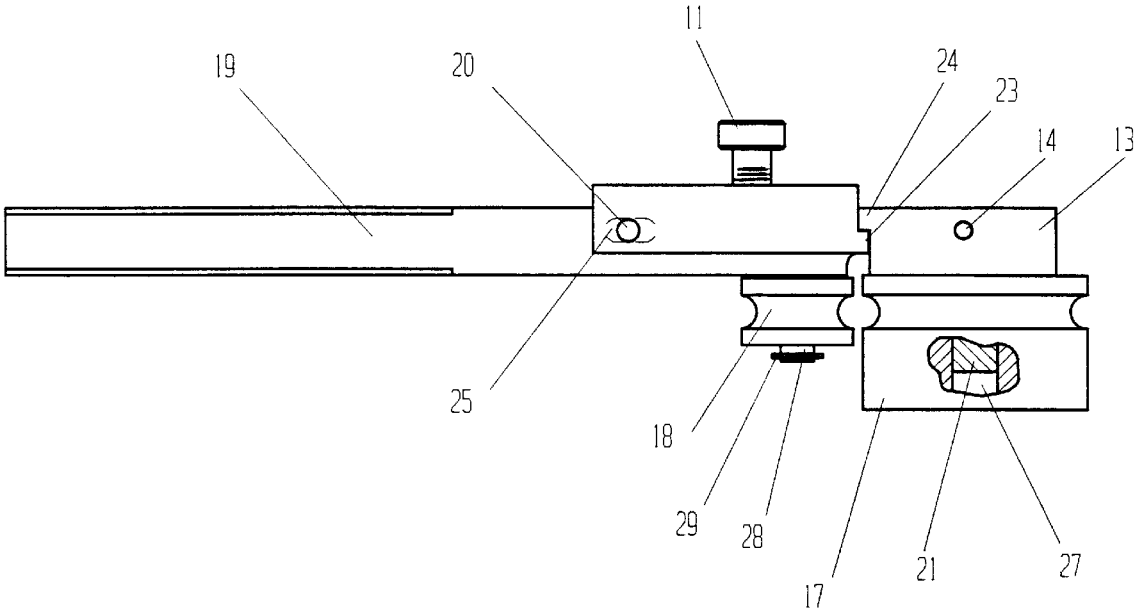
FIG. 2 shows a side view of the bend handle assembly and its relation to the pivot pin.
Figure 3:
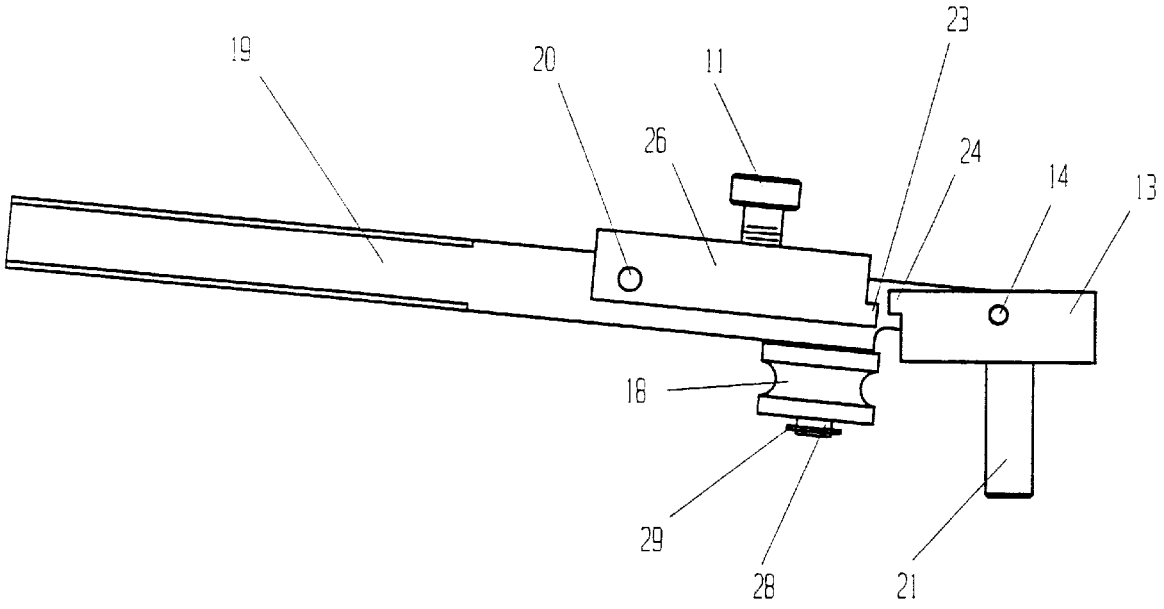
FIG. 3 shows a side view of the bend handle assembly with the inventive interlocking mechanism shifted to the left into the unlocked position allowing the handle to rotate up and out of the plane of bending for easy loading and unloading of the work piece.
Figure 4:
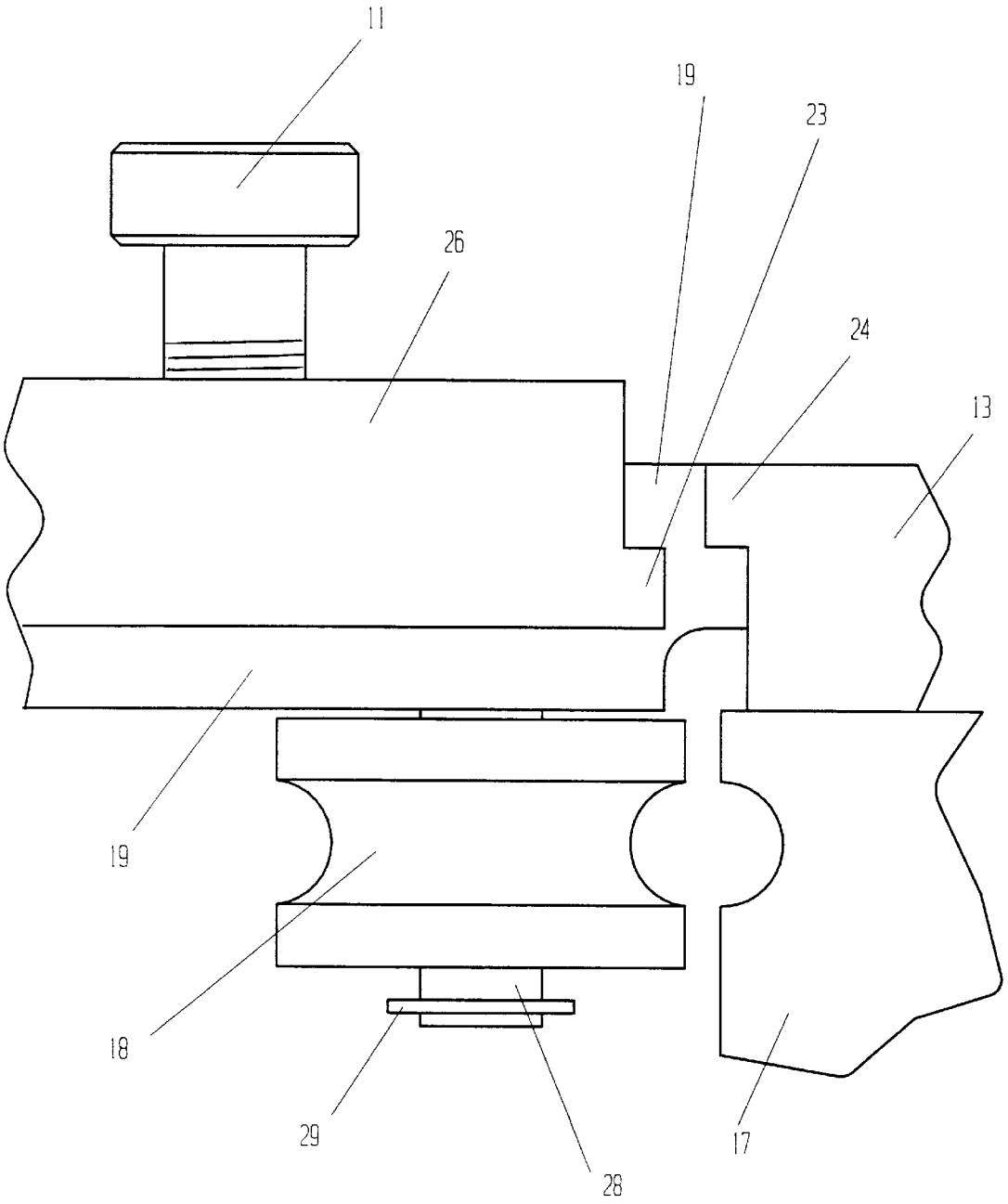
FIG. 4 shows an enlarged side view of the interlocking mechanism that prevents the bend handle from rotating up during the bending process.

From FIG. 2, a pivot pin 21 is fastened to a hinge plate 13. A handle 19 is pinned to hinge plate 13 by a hinge pin 14. Machined into hinge plate 13 is a first interlocking feature 24.

From FIGS. 1 and 2, an interlocking slide block 26 is comprised of a plate member and two leg members which together is U shaped in construction and rests upon handle 19. Also machined into interlocking slide block 26 is a second interlocking feature 23. A slide pin 20 keeps interlocking slide block 26 from dislodging from handle 19 by means of a slot 25 formed into the surface of handle 19. A thumb knob 11 is threaded into having a knurled section and a threaded fastener section interlocking slide block 26. Thumb knob 11 is able to thread through interlocking slide block 26 and make contact with handle 19.

A roller 18 is connected to handle 19 by a roller pin 28. Roller pin 28 is pressed into handle 19 and roller 18 is free to rotate about the axis of roller pin 28. Roller 18 is prevented from sliding off roller pin 28 by means of a clip 29.

Pivot pin 21 is allows handle 19 to rotate about the center of bend die 17 whereby pivot pin 21 is mated to a clearance hole 27 formed into bend die 17. Clearance hole 27 is concentric with the outside diameter of bend die 17.

In FIG. 1, work piece 22 is secured into clamp assembly 12. Handle 19 is rotated from the vertical position to the horizontal position. Interlocking slide block 26 is pushed forward toward hinge plate 13 until first interlocking feature 23 is butted against second interlocking feature 24. Thumb screw 11 is then advanced through interlocking slide block 26 until thumb screw 11 makes contact with handle 19. By tightening thumb screw 11 against handle 19, interlocking slide block 26, handle 19, and hinge plate 13 become rigid and thus prevent handle 19 from rotating about hinge pin 14.

By applying a light counter clock wise force to handle 19, roller 18 will make contact with work piece 22. By applying additional force to handle 19, work piece 22 will bend around bend die 17. The reaction force from the work piece 22 on the roller 18 is mostly resisted by the first and second interlocking features 23 and 24. If handle 19 were not prevented from rotating about hinge pin 14, the reaction force from work piece 22 on roller 18 would tend to cause roller 18 to ride up on work piece 22 while handle 19 is being forced to rotate about pivot pin 21. By engaging first and second interlocking features 23 and 24, handle 19 is confined to rotate about pivot pin 21 and not hinge pin 14 during the bending of work piece 22.

Figure 5:
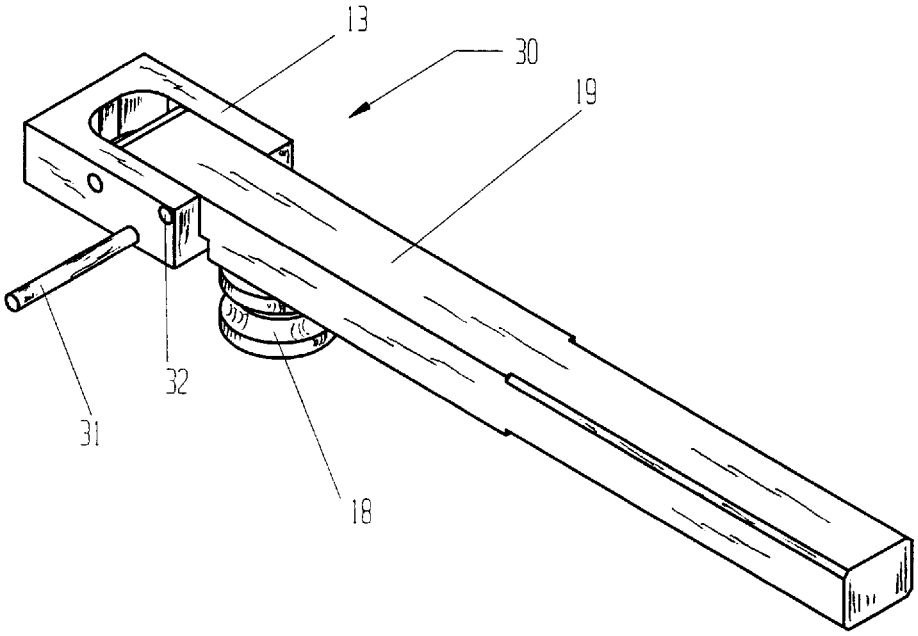
FIG. 5 shows a second embodiment that used a simple pin to prevent rotation about a hinged axis.

With reference to FIG. 5, a second embodiment 30 shown. Here slide block 26 is replaced by a lock pin 31. The advantage of this embodiment is less cost to employ.

Accordingly, the scope of the invention should be determined not by the embodiments illustrated, but by the appended claims and there legal equivalents.

I claim:

1. A mechanism used to prevent the rotation between a handle and its hinged connection with a bending device thus preventing it from rotating out of a plane of bending during a bending process, said mechanism allowing rotation of the handle with respect to its hinged connection before or after the bending process so as to allow for the loading or unloading of a workpiece from the bending device, said handle having a through-hole located at one end thereof and two blind slots, one on each opposing side of the handle, and spaced up the handle from said through-hole, said mechanism comprising:

a hinge plate fixedly connected at one end with said bending device, said hinge plate having a hinge pin for hingedly connecting the hinge plate to said handle by way of said through-hole thereof, said hinge plate further comprising first interlocking features mounted on a face thereof at an end opposite the fixed connection;

an interlocking slide block comprised of a plate member having a centrally located threaded bore and two leg members extending from said plate member and forming together a generally U-shaped construction, said slide block being slidably mounted on said handle by way of slide pins, one located on each of said leg members at one end thereof and being so directed as to engage respectively said two blind slots of the handle, said slide block further comprising second interlocking features on a face of each extending leg at an end opposite said one end having said slide pins and facing toward said hinge plate, said second interlocking features being mateable with said first interlocking features of said hinge plate to prevent the rotation of said handle relative to said hinge plate and the bending device, the pins of said slide block and slots of said handle allowing relative sliding movement between the handle and slide block and allowing contact between the slide block and the hinge plate and thus the mating of the first and second interlocking features; and a threaded fastener, said threaded fastener being threadedly located in the threaded bore of said slide block and adjustable so as to contact said handle and lock the slide block relative to the handle and said hinge plate thus allowing said interlocking members to be locked into contact.

2. The mechanism as claimed in claim 1, wherein said hinge pin is round in cross section.

3. The mechanism as claimed in claim 1, wherein said slide pins are round in cross section.

4. The mechanism as claimed in claim 1, wherein said threaded fastener has a knurled section to allow for the easy adjustment of the fastener into the slide block and into contact with the handle.

* * * * *